US007768423B2

(12) United States Patent
Camwell et al.

(10) Patent No.: US 7,768,423 B2
(45) Date of Patent: Aug. 3, 2010

(54) TELEMETRY TRANSMITTER OPTIMIZATION VIA INFERRED MEASURED DEPTH

(75) Inventors: Paul L. Camwell, Calgary (CA); James M. Neff, Okotoks (CA)

(73) Assignee: XAct Dowhole Telemetry Inc., Calgary, Ablerta (CA)

( * ) Notice: Subject to any disclaimer, the term of this patent is extended or adjusted under 35 U.S.C. 154(b) by 783 days.

(21) Appl. No.: 11/786,644

(22) Filed: Apr. 11, 2007

(65) Prior Publication Data

US 2007/0257810 A1 Nov. 8, 2007

Related U.S. Application Data

(60) Provisional application No. 60/790,802, filed on Apr. 11, 2006.

(51) Int. Cl.
*G01V 3/00* (2006.01)

(52) U.S. Cl. ..... 340/854.4; 367/82; 367/83; 166/250.01; 702/17; 175/40

(58) Field of Classification Search ..... 340/854.4, 340/855.6, 854.3; 367/82–83; 166/250.01; 702/17; 175/40
See application file for complete search history.

(56) References Cited

U.S. PATENT DOCUMENTS 4,293,936 A * 10/1981 Cox et al. ..... 367/82
5,128,901 A 7/1992 Drumheller
6,023,658 A * 2/2000 Jeffryes ..... 702/16
6,152,246 A * 11/2000 King et al. ..... 175/26
6,434,084 B1 * 8/2002 Schultz ..... 367/81
6,909,667 B2 * 6/2005 Shah et al. ..... 367/83
6,933,856 B2 * 8/2005 Schultz ..... 340/854.3
6,940,420 B2 * 9/2005 Jenkins ..... 340/855.6
6,968,909 B2 11/2005 Aldred et al.
7,163,065 B2 * 1/2007 Zhang et al. ..... 166/385
7,508,734 B2 * 3/2009 Fink et al. ..... 367/43

OTHER PUBLICATIONS

Norton J. Lapeyrouse, *Formulas and Calculations for Drilling, Production, and Workover*, 2nd edition, 2002, ISBN: 0750674520, printed from http://bks9.books.google.ca/books?id=xS_Lh8RxsMMC&pg=PA40&img=1&zoom=3&hl=en&sig=ACfU3U (portions of pp. 6-7 attached).

* cited by examiner

*Primary Examiner*—Albert K Wong
(74) *Attorney, Agent, or Firm*—Klarquist Sparkman, LLP

(57) ABSTRACT

A method whereby a downhole drilling transmission device that communicates to the surface automatically modifies its transmission parameters in order that it substantially improves its ability to adequately communicate with a surface receiver despite increasing signal attenuation between the two as the length of drillpipe increases. This utilizes a simple measure of localized downhole pressure that then relies upon a look-up table or similar that provides a correspondence between said pressure and measured depth. Such a look-up table or similar can be readily built by incorporating appropriate features of the planned well such as drilling fluid flow rate, drilling fluid density, drilling fluid viscosity, well profile, bottom hole assembly component geometry, drillpipe geometry, and indications as to whether the fluid is flowing or stationary.

Upon determining the measured depth the tool then can attempt to modify or augment appropriate telemetry parameters in order to keep the signal received at surface within required parameters, thus offsetting the degradation due to increasing attenuation.

15 Claims, 6 Drawing Sheets

TELEMETRY TRANSMITTER OPTIMIZATION VIA INFERRED MEASURED DEPTH

CROSS REFERENCE TO RELATED APPLICATION

This application claims the benefit of U.S. provisional patent application Ser. No. 60/790,802, filed Apr. 11, 2006, which is incorporated herein by reference.

FIELD

The present invention relates to telemetry apparatus and methods, and more particularly to acoustic telemetry apparatus and methods used in the oil and gas industry.

BACKGROUND

There are numerous methods, techniques and innovations designed to improve the oil and gas drilling process. Many of these involve feedback of various measured downhole parameters that are communicated to the surface to enable the driller to more efficiently, safely or economically drill the well. For example, U.S. Pat. No. 6,968,909 to Aldred et al. teaches a control system that combines measurement of downhole conditions with certain aspects of the operation of the drillstring. These downhole measurements are conveyed to the surface by well-known standard telemetry methods where they are used to update a surface equipment control system that then changes operation parameters. Closed loop two-way communication techniques like this, however, rely on the adequate detection at the surface of the telemetered parameters. It is standard in the drilling industry to control certain parameters of the downhole telemetry transmitter by downlinking appropriate commands from the surface. For example, changing the downhole drilling fluid pressure in a prescribed manner by changing the flow rate of the drilling fluid and subsequently monitoring this by a downhole pressure gauge is a common technique. Problems associated with this and similar downlinking techniques include false detection, slowing of the drilling process and the need to include human intervention in the process.

There are at present two standard telemetry techniques in common use—data conveyed via pressure waves in the drilling fluid and data conveyed via very low frequency electromagnetic waves, both originating at a downhole transmitter. Another telemetry technique beginning to emerge in the drilling arena is to convey the data via acoustic waves travelling along the drillpipe. All three technologies suffer from noise associated with the drilling operation, and all three similarly suffer signal attenuation at the surface as the well bore increases in length. These problems are illustrated herein by discussing some of the issues associated with the utilization of acoustic transmissions to transfer data from downhole to an acoustic receiver rig at the surface.

The design of acoustic systems for static production wells has been reasonably successful, as each system can be modified within economic constraints to suit these relatively long-lived applications. The application of acoustic telemetry in the plethora of individually differing real-time drilling situations, however, is less widespread. This is primarily due to it presently being an emerging technology and because of specific problems related to the increased in-band noise due to certain drilling operations, and unwanted acoustic wave reflections associated with downhole components such as the bottom-hole assembly (or "BHA"), typically attached to the end of the drillstring. The problem of communication through drillpipe is further complicated by the fact that drillpipe has heavier tool joints than production tubing, resulting in broader stopbands; this entails relatively less available acoustic passband spectrum, making the problems of noise and signal distortion even more severe. As the well is drilled and the amount of drillpipe increases there is a general degradation of the available acoustic passband properties, primarily through two effects: the non-identical dimensions of the drillpipes due to manufacturing tolerances and recuts of tool joints will narrow and distort the acoustic passband; the acoustic signal attenuation increase is directly related to the number of drillpipes.

The amount of drillpipe in the well is directly related to the 'measured depth' (MD), in contrast to the 'true vertical depth' (TVD), i.e. the vertical depth used in calculating the hydrostatic pressure in a well. Attenuation is also a function of the amount of wall contact with the drillpipe because this contact provides a means of extracting energy from acoustic waves travelling along the pipe. Typical attenuation values may range from 12 dB to 35 dB per kilometer.

Noise from many sources must be dealt with. For example, the drill bit, mud motor and the BHA and pipe all create acoustic noise, particularly when drilling. The downhole noise amplitude generally increases as rotation speed and/or the drilling rate of penetration increases. On the surface, noise originates from virtually all moving parts of the rig. Dominant noise sources include diesel generators, rotary tables, top drives, pumps and centrifuges.

Thus it is evident that channel issues and noise problems will increase with the measured depth, drilling rate and rotary speed.

In summary, the challenges to be met for acoustic telemetry in drilling wells include:

- Restricted channel bandwidth due to the drillstring passband structure (see U.S. Pat. No. 5,128,901 to Drumheller)
- Channel centre shifts
- Dynamically changing channel properties
- Downhole noise due to drillpipe movements
- Downhole noise due to mud motor and/or drill bit activity
- Surface noise due to rig components such as diesel generators, rotating tables, and top drives Channel impairments generally degrade the signal's amplitude and/or phase integrity, while noise impedes the receiver's ability to detect what signal there is. A very simple metric that is used in these circumstances is the signal-to-noise ratio (SNR). Maximizing the SNR is a telemetry objective. Certain embodiments of the present invention teach a novel means of enabling the automatic control of various transmitter parameters so as to maintain the SNR available at surface at or above a minimum achievable and predetermined threshold in the acoustic drilling telemetry environment. It can equally be applied to the other major telemetry means indicated herein as they have similar SNR issues resulting from their own associated telemetry channel impairments.

SUMMARY

It is an object of certain embodiments of the present invention to optimize the telemetry performance of a simple one-way (subsurface to surface) telemetry link from the downhole transmitter through the appropriate channel to a receiver located on the rig at surface. For convenience the telemetry performance is defined simply as the ability of the surface receiver to decode the telemetered parameters detected at surface in the presence of noise. It is evident that the noise sources as discussed are present to an extent that depends on the immediate needs of the rig crew actually drilling and steering the well. It is also evident that the signal attenuation will increase as the well is drilled, bringing more drillpipe and more wall contact. The present invention is directed to enhancing the received signal in order to offset the reduction in SNR as the MD increases by implementing one or more of the following exemplary actions, which are for illustrative purposes only:

signal repetition
reduced data rate
increased signal length
increase the signal's frequency span
increase the transmitter's output level Undertaking these actions is not novel in itself; it is the means by which these techniques are employed, as explained below.

If the transmitter module had access to the MD of the drillpipe it could be programmed to undertake certain of the SNR improvements at specified MDs. In the case of acoustic telemetry for instance, at each 500 m increment a combination of signal increase and chirp length could be implemented. Because the telemetry system to which the present invention beneficially but not exclusively applies is for one-way systems, the downhole tool may not be in receipt of this information from the surface, and thus an inferential method would be utilized. The basis for the present invention is to infer the approximate measured depth (i.e. the total length of the drill pipe) by measuring downhole pressure. Pressure values are readily available by the use of one or more pressure sensors that can sample bore pressure, annular pressure or both. The majority of downhole telemetry tools incorporate at least one pressure sensor as this is an important parameter in safely drilling a well. Once the pressure is determined the most straightforward inferential method is to utilize a look-up table that is configured around particular parameters of the well being drilled.

According to one aspect, there is provided a method and apparatus for enhancing downhole telemetry performance. The method comprises: measuring downhole pressure at a specified location; inferring a measured depth from the measured downhole pressure; and modifying a downhole telemetry signal at one or more measured depths in order to offset the estimated signal-to-noise ratio reduction with increasing measured depth. The apparatus comprises: a pressure sensor for measuring downhole pressure at a specified location; a telemetry signal transmitter; and a processor with a memory having recorded thereon steps and instructions for carrying out the method.

The measured depth calculation becomes more complicated when the well deviates from vertical. This deviation can be assessed by the use of a 'direction and inclination' sensor (D&I) commonly deployed downhole. The issue is that even though the angle in the hole is known, prior to this invention the downhole tool is not able to assess its distance along the deviated section(s) of the well without information being relayed from the surface. Our invention provides an inferential method of estimating MD for all sections of the well.

The step of inferring can be performed even when the specified location is in a horizontal section of a well bore, comprising measured downhole pressure(s) with a form of a previously-calculated equivalent circulating density estimate for specified locations, with preferably, although necessarily a correlation of D&I angle of well trajectory measurements. The pressure sensor can usually be configured to measure annulus pressure or bore pressure or both. The step of inferring a measured depth can comprise associating a measured annulus pressure to a predicted annulus pressure then selecting a measured depth corresponding to the associated predicted annulus pressure.

The method can be performed in a drill string having a bottom hole assembly with no repeater. In such case the specified location is the location of the bottom hole assembly in a well bore. Alternatively, the method can be performed in a drill string having a bottom hole assembly and at least one repeater; in such case the specified location is the location of the repeater closest to the surface, and the step of inferring measured depth comprises inferring a first measured depth between the specified location and the surface, incorporating a predetermined second measured depth between the specified location and the bottom hole assembly, then combining the first and second measured depths.

BRIEF DESCRIPTION OF THE DRAWINGS

The following drawings illustrate the principles of the present invention and an exemplary embodiment thereof.

DETAILED DESCRIPTION

Figure 1:
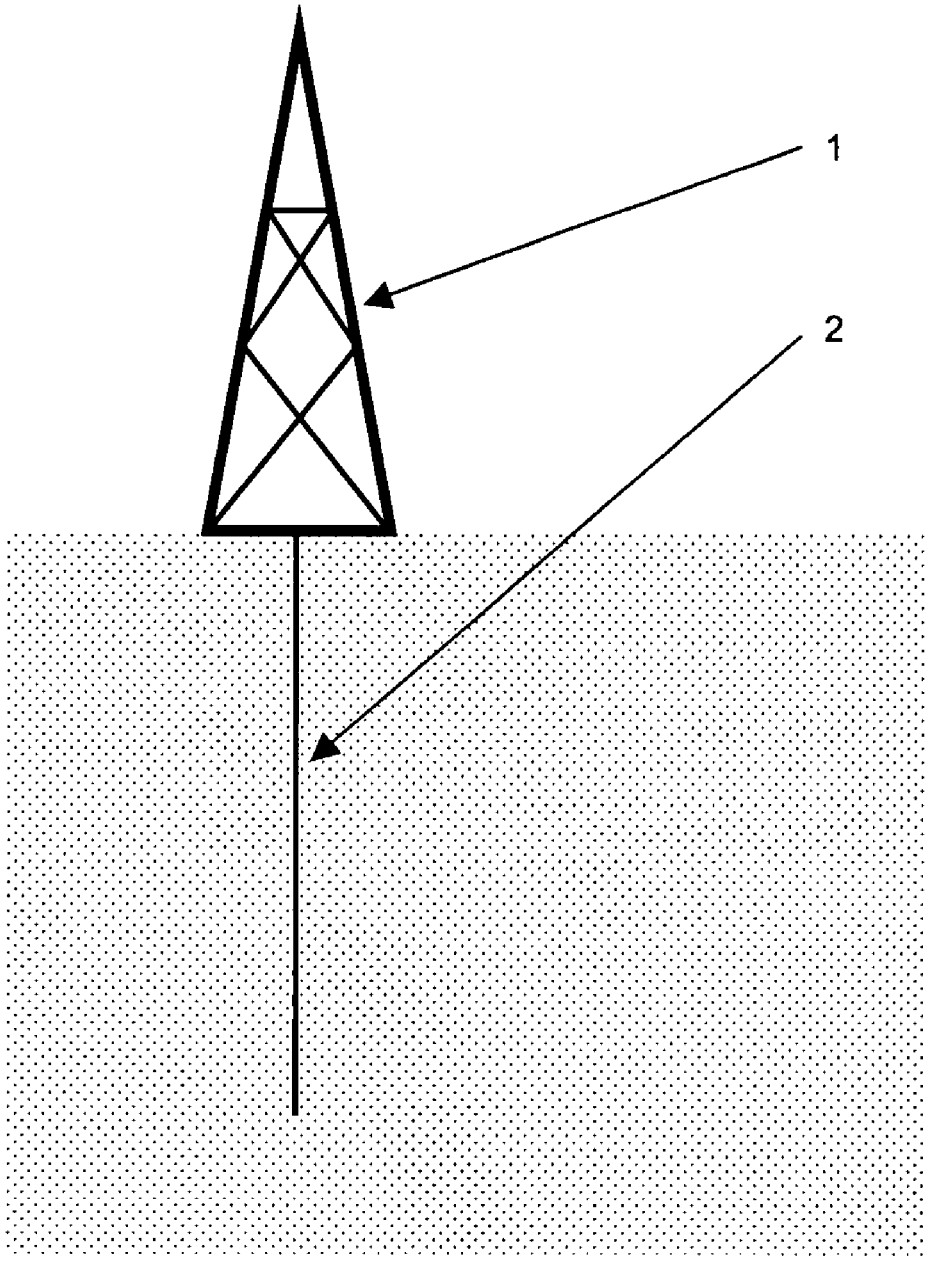
FIG. 1 is schematic representation of a rig 1 and the profile 2 of a vertical well.

It is apparent from FIG. 1 that the MD is readily predicted by the downhole tool by measuring the downhole hydrostatic pressure $P_{hs}$ once the fluid density is known or assumed, as predicted by equation 1:

$$P_{hs}=\rho gh \quad [1]$$

where

ρ=drilling fluid density
g=acceleration due to gravity
h=vertical height of the fluid column It is normal that during the course of drilling a well the density ρ is deliberately changed. Furthermore ρ can change depending on whether the fluid is being pumped or is stationary. It can also change depending on the volume and type of cuttings and how they are held in suspension. This effect leads to consideration of an equivalent circulating density calculation (ECD, equation 2, following) that is utilized for the control and safety of modern wells.

The present invention as applied to reasonably vertical wells is to utilize the pressure readings when the flow is static.

At the well planning stage it will be known to an adequate degree of accuracy how the well profile and the addition of materials to the drilling fluid will affect the downhole pressure $P_{hs}$. It does not matter whether the sampled pressure is that in the bore or in the annulus—they are almost the same under static conditions. Thus a look-up table that equates pressure $P_{hs}$ to MD can be constructed, where it is assumed that h is equivalent to MD. It is then apparent that relatively coarse changes in MD (for example, increments of 500 m) can be inferred by assessing $P_{hs}$ that in turn can implement changes in the transmitted signal in a way that increases SNR and thus will improve detection and decoding ability of the surface equipment. Such a look-up table or similar can be readily built by incorporating appropriate features of the planned well such as drilling fluid flow rate, drilling fluid density, drilling fluid viscosity, well profile, bottom hole assembly component geometry, drillpipe geometry, and indications as to whether the fluid is flowing or stationary.

If the value of ρ is changed, as noted above, this effect can easily be accommodated by planned incremental changes for ρ in the look-up table that are applied to the successively deeper sections of the well. For instance if the static pressure changes in excess of a given threshold between one predetermined pressure in the table and the next, the inference is that the increase is due primarily to a planned increase in mud density and not simply an increase in TVD.

Figure 2:
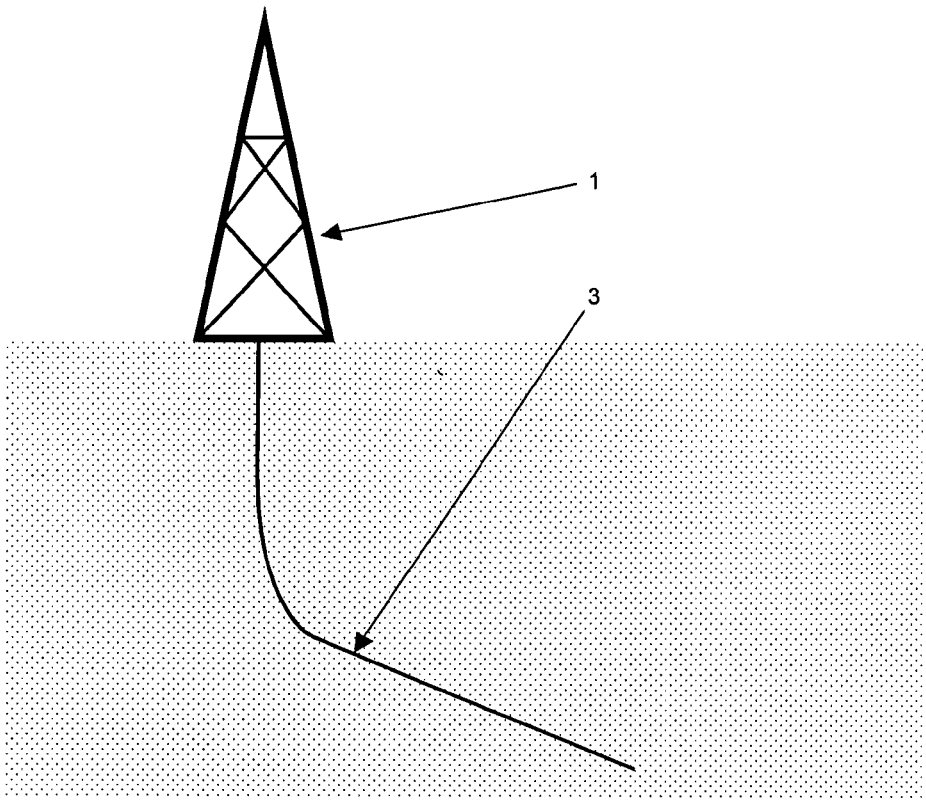
FIG. 2 further shows the profile 3 of a deviated well.

FIG. 2 adds a minor complication in that once a given depth is encountered the well is steered away from vertical at some predetermined angle, as could conveniently be assessed by the D&I package, although our invention does not require this as the angular deviation may be also inferred from simple static pressure changes. The correspondence of pressure to MD is modified in an obvious manner using simple geometry.

It is now apparent that the look-up table as described is a viable method of determining MD in deviated wells. However it is known that in the art that FIG. 2 is an oversimplification of practical wells because it is not usually possible to drill a well in a perfectly straight line for any significant distance. The driller's job includes the need to continually correct the profile by making relatively small steering adjustments. In most instances these corrections are small enough that the method as described herein will remain substantially valid.

Figure 3:
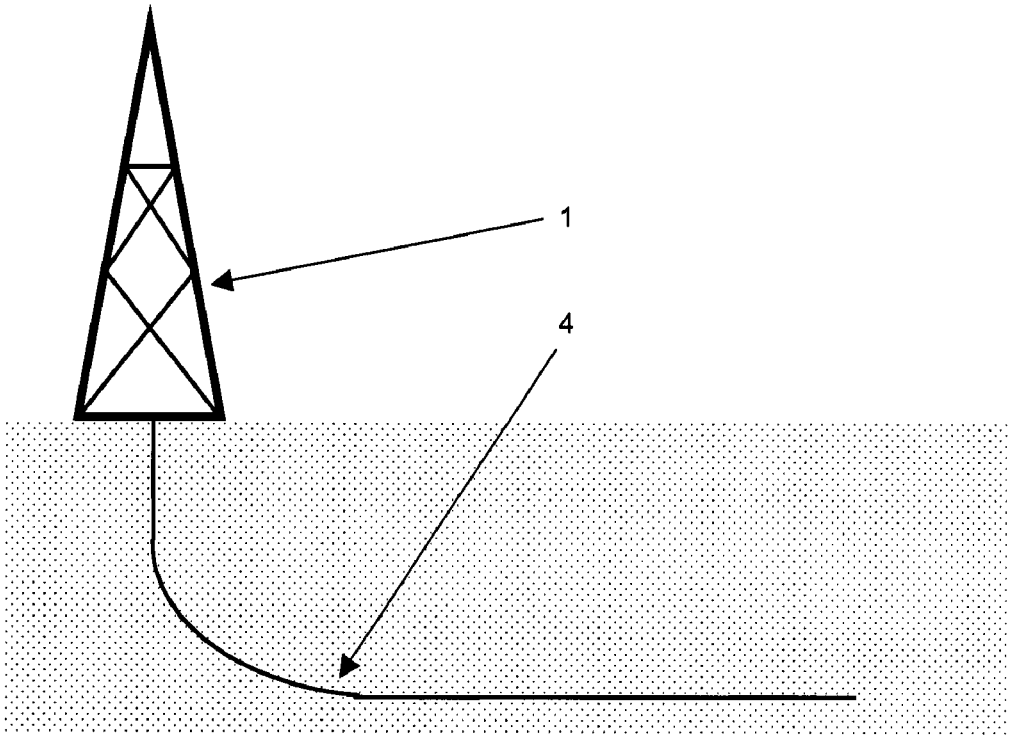
FIG. 3 further shows the profile 4 of a typical horizontal well.
Figure 4:
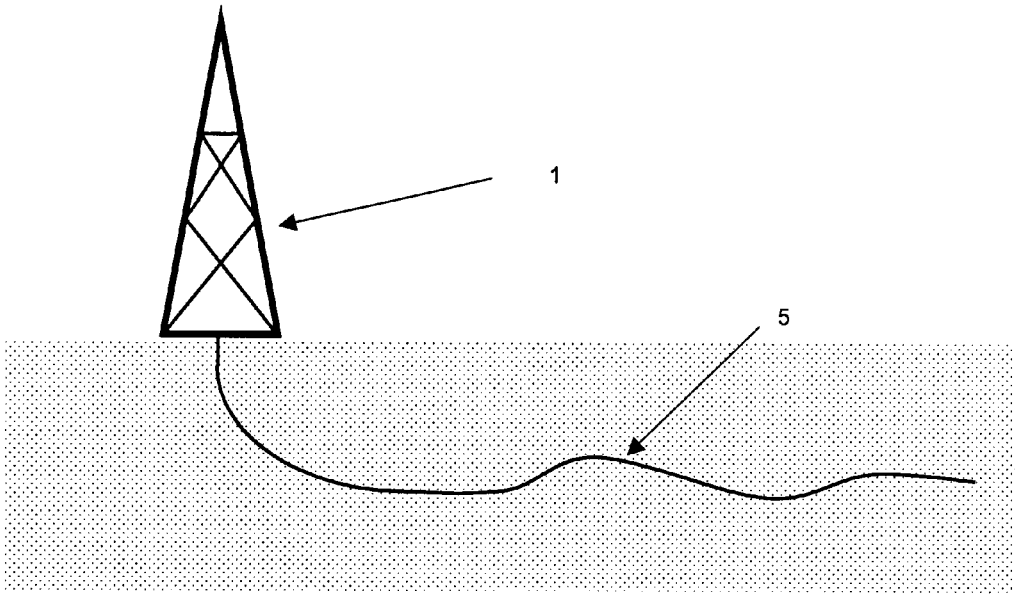
FIG. 4 further shows the profile 5 of a typical extended reach well.

FIG. 3 adds an apparently major obstacle to inference of MD because the profile 4 contains a section of horizontal well, thus rendering equation 1 inappropriate for this section. In practical drilling applications horizontal sections are included in a class of wells called 'extended reach drilling' (ERD) wells, as depicted in FIG. 4. The profile 5 can be typical of a directional well containing not only horizontal sections but also generally positive sloped sections and generally negative sloped sections. This is because in many circumstances it is necessary to follow a target formation that undulates in TVD. In a proportion of these wells the generally horizontal section is relatively short compared to the vertical section. In these cases it would be adequate to use the look-up table to maximize the SNR improvements for the whole of the horizontal section.

Figure 5:
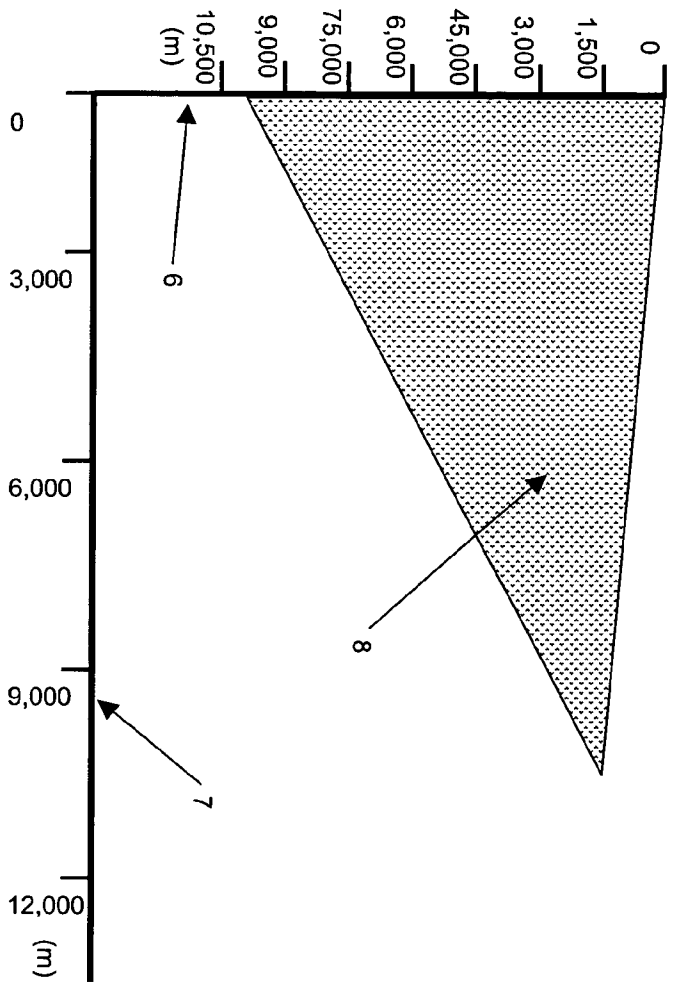
FIG. 5 is a graph showing a consolidation of the overall drilling industry preferences when drilling wells that incorporate non-vertical sections.

In many ERD wells, however, the generally horizontal drilled section is equal to or greater than the length of the vertical section. This is indicated in FIG. 5, where the X-axis 6 depicts TVD in meters and the Y-axis 7 depicts the horizontal displacement (departure) from vertical in meters. The hatched section 8 in this figure consolidates and presents the industry well drilling practice for these parameters over the last 40 years. Although it is not obvious from FIG. 5, roughly 67% of ERD wells have a departure from vertical greater than their TVD. Because the well types typified by FIGS. 3 and 4 are a very significant fraction of the total number of wells drilled, incorporating another technique is necessary for the MD estimation procedure. According to the present invention, the pressure can also be measured under flow (dynamic) conditions and use is then made of a prediction of ECD versus MD. A greatly simplified explanation of this and its relevance to the present invention is as follows.

The annular pressure AP due to dynamic flow increases with flow rate and pipe length (i.e. MD) because of factors such as the increase in friction both inside and outside the drillpipe. AP also usually increases to a relatively small extent (a few percent) with cuttings in the annulus because they restrict flow (particularly at the tool joint sections) and also increase in net fluid density when the cuttings are in suspension. Because of the generally small effect of cutting, they will be neglected hereon as they do not modify the principles embodied in this invention.

As the AP value changes it also equally changes the bore (internal pipe) pressure because the drilling fluid flows continuously from bore to annulus. Therefore we could equivalently measure the bore pressure if that happened to be more convenient, or indeed, as necessitated by the type of pressure gauge in the BHA.

The simplest form of the calculation of ECD is (for instance see *Formulas and Calculations for Drilling, Production and Workover,* 2'nd edition; publisher: Butterworth-Heinemann; 2002, ISBN: 0750674520):

$$ECD=MW+(AP/(0.052\times TVD) \quad [2]$$

where

MW=drilling fluid (mud) weight (pounds per gallon)

AP=annulus pressure drop (psi) between surface and the depth at TVD

TVD=true vertical depth (feet)

Sophisticated algorithms are readily available to quantify AP in the well planning stage and thus predict ECD at any position along the planned well trajectory by taking into account the many variables that modify the predicted value of ECD. The present state of the art is that predicted ECD compared to actual ECD can be accurate to within ~5% for a calibrated model, or ~10% or more for a non-calibrated model. We take advantage of this standard calculation to incorporate the pressure drop in excess of the hydrostatic drop (equation 1) and incorporate the total pressure drop expected at each stage of the well's progress into the look-up table, the ECD-related calculations being particularly pertinent for the stages where deviations from vertical are significant. This procedure merely complicates the table (or similar) entries, and requires that certain drillstring parameters are taken into the flow condition calculations. We point out that we do not actually need to calculate ECD; we need only to compute the relationship of AP to MD, this forming a part of the derived ECD calculations commonly utilized in the drilling industry. The AP value we use is directly associated with length of drillpipe along the whole length of the well bore (i.e. MD) and the BHA geometry.

We are assuming in these cases that the planned flow rate is followed in practice. If it is not, an error proportional to the square of the flow velocity is introduced in the pressure p calculation, as would be given in the simplest form (laminar flow) by Daniel Bernoulli's hydrodynamic equation (see for instance H. Lamb, *Hydrodynamics,* 6th ed., Cambridge University Press, 1953, pp. 20-25):

$$p+\tfrac{1}{2}\rho v^2+\rho g\Delta h=\text{constant} \quad [3]$$

where v=fluid velocity

Δh=vertical height change over which pressure p is measured

If the BHA pressure gauge has both bore and annulus pressure measuring capabilities, one can make use of equation 3 by measuring the differential pressure (i.e. bore—annulus) that is normally sensed across the mud motor and drill bit, thereby estimating the velocity v. Either a calculation or a calibration can be used to link v to p. This value of v can be used to modify the tabular entries to a specific set of flow velocities, and thereby obtain a more accurate estimate of MD, as indicated below.

Once v is calculated in this manner (or assumed from preset table entries) then the appropriate annular pressure AP (equation 2) can be associated with a specific flow velocity. The next step is to recognise that the total dynamic annular or bore pressure $P_{tool}$ as measured by the downhole BHA tool in these types of wells is given by:

$$P_{tool}=P_{hs}+\mathrm{AP} \quad [4]$$

where we have separated the hydrostatic head component of pressure ($P_{hs}$) and the hydrodynamic pressure drop associated only with flow in equation 4. Thus in a well with significant horizontal sections a combined measure of static and a dynamic pressures can be used to isolate AP. AP has already been calculated and is in tabular form in a look-up table (or similar) in the downhole tool. Because AP is a function of v and if v is known, it is now obvious that a reasonable estimate of AP can be mapped directly to MD. If v is not measured the assumed value of v is utilized in a simpler table, with a somewhat lesser degree of accuracy in MD. Either way, because we use MD in a coarse incremental fashion (e.g. increments of ~500 m) the changes to transmission parameters that modify SNR will not be significantly suboptimal.

The methods described herein can also beneficially apply to drilling circumstances where downlinking to the telemetry tool is possible. This is because the automatic nature of the telemetry changes associated with sampling downhole pressure makes it unnecessary for surface control or intervention to be applied to the task of ensuring adequate received SNR under most drilling conditions.

Figure 6A:
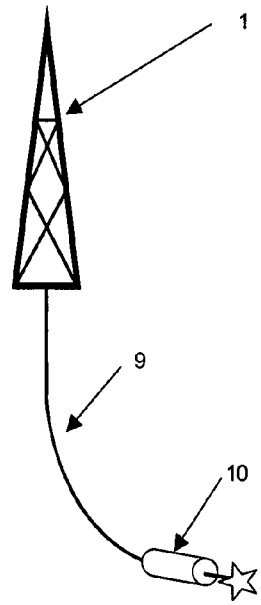
FIG. 6*a* is a schematic representation of a rig with a depiction of a downhole telemetry tool.
Figure 6B:
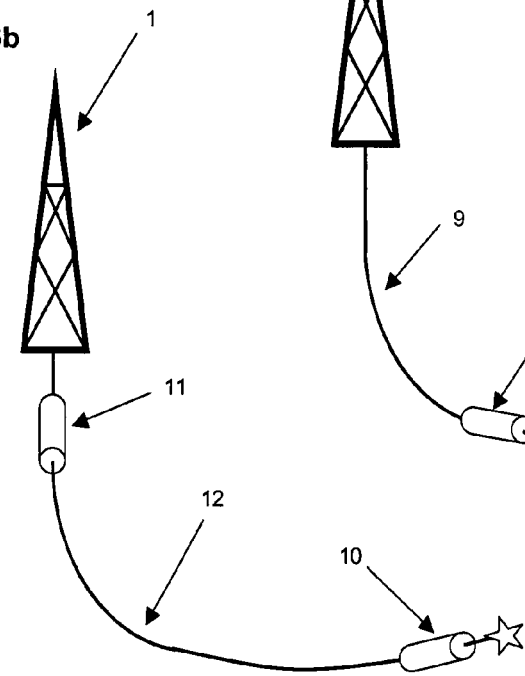
FIG. 6*b* is a schematic representation of a rig with a depiction of a downhole telemetry tool with the addition of a repeater telemetry tool.
Figure 6C:
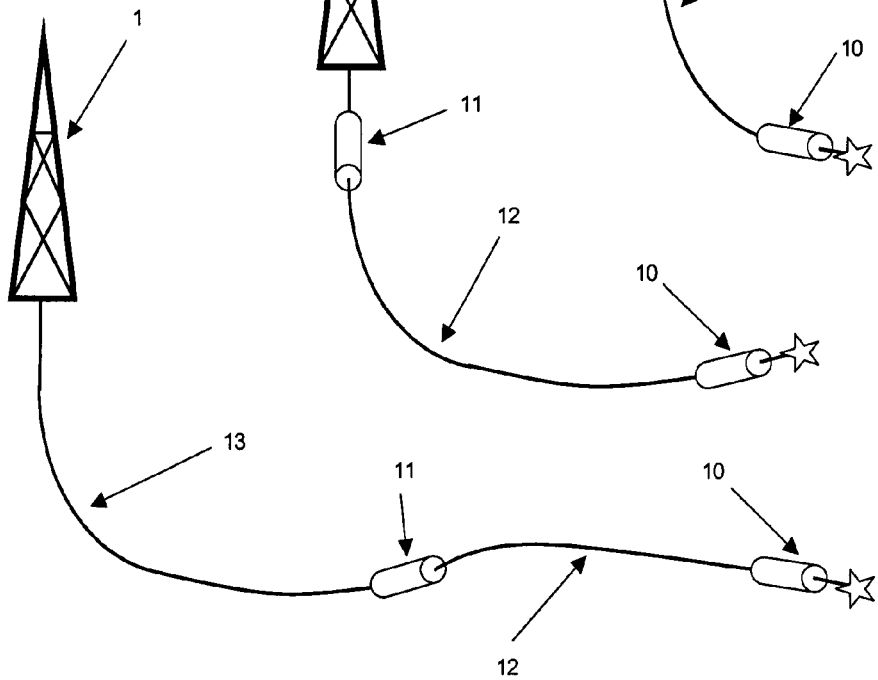
FIG. 6*c* is a schematic representation of the representation depicted in FIG. 6*b* but indicating a situation where drilling has progressed.

Furthermore, the methods described herein can also beneficially apply to drilling circumstances where a telemetry repeater tool is also included in the drillstring. FIG. 6*a* depicts the conventional start of a deviated well where the BHA 10 (including drilling means and telemetry tool) is separated from the rig 1 by a length (MD) of drillpipe 9. The invention as previously discussed applies to this stage. The next stage is to insert a repeater 11 as shown in FIG. 6*b*. The amount of drillpipe between repeater 11 and BHA has now a planned increase 12 that is intended to enable communications over approximately twice the distance that limits a non-repeater circumstance. Because it is known in the well planning stage that a repeater would be inserted at a specific MD, the look-up table or similar means would now fix the appropriate telemetry parameters to values suitable for adequate communications from the BHA telemetry device 10 to the repeater 11. The invention now applies to control of the appropriate telemetry parameters associated with the repeater 11, as shown in FIG. 6*c*. As the well progresses the drillpipe length 13 between the repeater and the rig increases, and SNR communication to the rig is modified by the look-up table or similar within the repeater, enabling efficient communication as before.

In summary, it is possible for the tool to make an approximate inferred estimate of its MD by making use of standard downhole sensors and assessing the downhole pressure. Thus, the tool could be programmed to automatically adjust certain of its acoustic transmitted parameters such that it could compensate for the surface reduction in SNR caused by increasing attenuation due to increasing MD. The present invention therefore provides a method by which tool telemetry decoding performance may be maintained at or above a specified threshold with increasing well length without the need to communicate to the tool from the surface. This method also includes the circumstances where one or more repeaters are incorporated, as would now be understood by one skilled in the art.

We claim:

1. A method for enhancing downhole telemetry performance in a drill string comprising (a) measuring downhole pressure at a specified location;

(b) inferring a measured depth from the measured downhole pressure; and (c) modifying a downhole telemetry signal at one or more measured depths in order to offset signal-to-noise ratio reduction with increasing measured depth.

2. A method as claimed in claim 1 wherein the downhole pressure is hydrostatic pressure measured under static flow conditions.

3. A method as claimed in claim 1 wherein the downhole pressure is measured under moving flow conditions.

4. A method as claimed in claim 3 wherein the step of inferring comprises correlating the measured downhole pressure with the measured depth using a predicted equivalent circulating density at the specified location.

5. A method as claimed in claim 4 wherein the measured downhole pressure is selected from the group consisting of annulus pressure and bore pressure.

6. A method as claimed in claim 5 wherein the step of inferring a measured depth comprises associating a measured annulus pressure to a predicted annulus pressure then selecting a measured depth corresponding to the associated predicted annulus pressure.

7. A method as claimed in claim 5 comprising measuring a differential pressure between annulus and bore to determine downhole fluid flow velocity, then associated annulus pressure from the determined velocity.

8. A method as claimed in claim 1 wherein the method is performed in a drill string having a bottom hole assembly with no repeater, and the specified location is the location of the bottom hole assembly in a well bore.

9. A method as claimed in claim 1 wherein the method is performed in a drill string having a bottom hole assembly and at least one repeater, the specified location is the location of the repeater closest to the surface, and wherein the step of inferring measured depth comprises inferring a first measured depth between the specified location and the surface, determining a second measured depth between the specified location and the bottom hole assembly, then combining the first and second measured depths.

10. An apparatus for enhancing downhole telemetry performance comprising:

(a) a pressure sensor for measuring downhole pressure at a specified location;

(b) a telemetry signal transmitter;

(c) a processor with a memory having recorded thereon steps and instructions for i. inferring a measured depth from the measured downhole pressure; and ii. modifying a downhole telemetry signal of the transmitter at one or more measured depths in order to offset signal-to-noise ratio reduction with increasing measured depth.

11. An apparatus as claimed in claim 9 wherein the step of inferring comprises correlating the measured downhole pressure with the measured depth using a predicted equivalent circulating density at the specified location.

12. An apparatus as claimed in claim 11 wherein the pressure sensor is configured to measure annulus pressure or bore pressure or both.

13. An apparatus as claimed in claim 12 wherein the step of inferring a measured depth comprises associating a measured annulus pressure to a predicted annulus pressure then selecting a measured depth corresponding to the associated predicted annulus pressure.

14. An apparatus as claimed in claim 10 wherein the apparatus is part of a bottom hole assembly in a drill string with no repeater and the specified location is the location of the bottom hole assembly in a well bore.

15. An apparatus as claimed in claim 10 wherein the apparatus is part of a repeater in a drill string having a bottom hole assembly and at least one repeater and the specified location is the location of the repeater closest to the surface, and wherein the step of inferring measured depth comprises inferring a first measured depth between the specified location and the surface, determining a second measured depth between the specified location and the bottom hole assembly, then combining the first and second measured depths.

* * * * *